US006575135B2

(12) United States Patent
Muraji

(10) Patent No.: US 6,575,135 B2
(45) Date of Patent: Jun. 10, 2003

(54) THROTTLE VALVE CONTROL DEVICE

(75) Inventor: Tetsuo Muraji, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/303,005

(22) Filed: Nov. 25, 2002

(65) Prior Publication Data

US 2003/0070657 A1 Apr. 17, 2003

Related U.S. Application Data

(63) Continuation of application No. PCT/JP01/04418, filed on May 25, 2001.

(51) Int. Cl.[7] ..... F02D 31/00
(52) U.S. Cl. ..... 123/399; 123/339.27
(58) Field of Search ..... 123/399, 339.27, 123/339.14, 319, 395; 251/129.15

(56) References Cited

U.S. PATENT DOCUMENTS 5,517,966 A * 5/1996 Kanazawa et al. ..... 123/396
5,546,903 A * 8/1996 Satou et al. ..... 123/399
5,975,051 A * 11/1999 Yamada et al. ..... 123/396

FOREIGN PATENT DOCUMENTS

| | | |
|---|---|---|
| JP | 63-115546 | 7/1988 |
| JP | 08-232690 | 9/1996 |

* cited by examiner

*Primary Examiner*—Bibhu Mohanty
(74) *Attorney, Agent, or Firm*—Wenderoth, Lind & Ponack, L.L.P.

(57) ABSTRACT

The throttle valve control device of the present invention comprises a structural body 24 in which a throttle valve 21, a throttle shaft 22 and a throttle lever 23 are integrally connected, a return spring 26, one end of which is latched to the structural body 24, and which urges the throttle valve so as to rotate in the closing direction, a free lever 25 which is engaged with the other end of the return spring, and which can contact and move away from the structural body, and an actuator 30 which drives the free lever. The driving of the free lever by the actuator causes the structural body to pivot, so that the throttle valve is opened and closed in a specified range, thus controlling the idle speed. As a result, a throttle valve control device which has a simple structure and which can be made compact is provided.

4 Claims, 5 Drawing Sheets

THROTTLE VALVE CONTROL DEVICE

REFERENCE TO RELATED APPLICATION

This is a continuation of International Application PCT/JP01/04418, filed May 25, 2001, the entire contents of which is incorporated herein by reference.

1. Technical Field

The present invention particularly relates to a throttle valve control device which is capable of fine control of the amount of intake air required for idling operation in an internal combustion engine.

2. Background Art

In internal combustion engines used in automobiles, the idling operation in particular requires fine control of the amount of intake air in accordance with the temperature conditions of the environment and equipment, and in accordance with the conditions of use of peripheral equipment such as air conditioning and the like. In the past, various proposals have been made regarding such control.

For example, there is a method in which a bypass air passage is formed parallel to the throttle valve, a flow rate control valve is installed at an intermediate point in this bypass air passage, and the amount of air that flows through the bypass air passage is controlled by this valve.

However, in the case of this control method, a safety measure is taken in which the inflow into the bypass air passage is restricted by a temperature-sensing element utilizing the temperature during engine warm-up in order to prevent an unnecessarily large amount of intake air from being supplied to the engine as a result of trouble with the actuator that drives the flow rate control valve. As a result, the structure of the apparatus is complicated.

Accordingly, a method has been devised in which the throttle valve is directly driven by a DC motor or the like in the low-opening region of the throttle valve, i.e., the so-called idle speed control (ISC) region (hereafter referred to as the ISC region).

FIG. 5 shows a universally known example of such a throttle valve control device; this figure is a diagram which shows the construction of the device in schematic form. The throttle valve 1 is mounted inside the bore of a throttle body (not shown in the figures) by means of a throttle shaft 2, so that the throttle valve 1 can rotate in either the opening or closing direction as indicated by the arrows(while the arrows are linear in the drawings in the application, it is understood that the movement represented in the schematic drawings of this application is rotational). A first lever 3 and second lever 4 are attached to respective ends of the throttle shaft 2.

The second lever 4 is loosely mounted inside a space between walls 5*a* and 5*b* formed in a throttle lever 5. The first lever 3 contacts a free lever 6, and the free lever 6 is integrally connected to a DC motor 7 via a gear speed-reduction device (not shown in the figures).

One end of a first spring 9 and one end of a second spring 10 are connected to the throttle body 8. The other end of the first spring 9 is anchored on the free lever 6, and the other and of the second spring 10 is anchored on the second lever 4.

The fully open position of the throttle lever 5 is regulated by a "fully-open" stopper 11, and the initial position of idling (when no electric power is applied) is determined by an idling stopper 12. Furthermore, the upper limit position of ISC is regulated by an ISC stopper 13, and the ISC stopper 13 is disposed in a position located at a far lower degree of opening than the "fully-open" stopper 11.

The idling stopper 12 has a spring 12*a* inside, and the initial position of idling can be adjusted by adjusting a movable stopper 12*b* by means of a screw or the like (not shown in the figures). Furthermore, the internal spring 12*a* is set at a value that is equal to or greater than the synthesized value of the first return spring 9 and second return spring 10, so that when the DC motor 7 is not powered, the degree of opening of the throttle valve is determined by the position that is set by the movable stopper 12*b* of the idling stopper 12.

The operation of the accelerator pedal during normal operation (of the vehicle) is transmitted to the throttle lever 5 via a throttle link. When the throttle lever 5 moves in the opening direction, the wall 5*a* quickly contacts the second lever 4, thus moving the second lever 4 against the driving force of the second spring 10, and this movement acts on the throttle valve 1 via the throttle shaft 2 so that the valve opens. With the throttle valve 1 open, an operation by means of the accelerator pedal can be performed until the throttle lever 5 contacts the "fully-open" stopper 11.

When the depression of the accelerator pedal is relaxed from the fully open position of the throttle valve 1, the throttle valve 1 is pulled back by the second return spring 10 in a state in which the wall Sa of the throttle lever 5 and the second lever 4 are in contact, so that the throttle valve 1 moves in the closing direction. The first lever 3 then quickly contacts the free lever 6 and stops. The throttle lever 5 is caused to remain static by a link (not shown in the figures), and even if the movable stopper 12*b* is displaced, the second lever 4 is between the walls 5*a* and 5*b*, so that the position of the throttle lever 5 does not change.

In ISC, the DC motor 7 is driven so that the first lever 3 is driven in the opening or closing direction via a gear train. Since the driving force of the DC motor 7 is greater than the force of the internal spring 12*a* of the idling stopper 12, the throttle valve can also be set at a degree of opening that is less than that of the movable stopper 12*b*. Movement in the opening direction is limited by the ISC stopper 13.

As a result of the abovementioned construction, the degree of opening can be freely adjusted by the DC motor 7 between the idling stopper 12 and the ISC stopper 13. Outside this range, the degree of opening of the throttle valve is determined by the accelerator pedal operation of the driver.

In the abovementioned conventional example, the degree of opening of the throttle valve 1 when power is not applied is ensured, and the throttle valve can be directly controlled by the DC motor in the low-opening region in a range of L1. Accordingly, a bypass air passage is unnecessary.

However, in the abovementioned example, two return springs are needed, i.e., a first return spring and a second return spring, as opposed to a single return spring in a conventional device. As a result, the structure of the throttle body is complicated.

Furthermore, when the free lever 6 is moved by the DC motor, the driving forces of the two return springs or the internal spring 12*a* increase in accordance with the amount of movement, so that a variation occurs in which the driving forces are different in the opening and closing directions. As a result, control of the degree of throttle opening by the motor current is difficult, and the control circuit becomes complicated. Moreover, the motor must have a large output in order to overcome the driving force of the springs, and this leads to the problems of increased size and increased cost of the apparatus.

The present invention solves the abovementioned problems. It is an object of the present invention to provide a throttle valve control device which has a simple structure, and which can be made compact.

SUMMARY OF THE INVENTION

In order to achieve the abovementioned object, the throttle valve control device of the present invention comprises a structural body in which a throttle valve which is disposed inside the bore of a throttle body, a throttle shaft which supports the throttle valve so that this throttle valve is free to pivot, and a throttle lever that pivots the throttle shaft, are integrally connected. A return spring has one end anchored to the structural body and urges the throttle valve so that the throttle valve rotates in the closing direction. A free lever is supported on the throttle shaft so that this free lever is free to pivot, anchors the other end of the return spring, and can contact and move away from the structural body. An actuator drives the free lever. The driving of the free lever by the actuator causes the structural body to pivot, so that the throttle valve is opened and closed.

A construction may be used in which the actuator opens and closes the throttle valve within the ISC region.

Furthermore, a construction may be used in which the actuator has a stator including a magnetic flux generating part, around which an electromagnetic coil is wound so that magnetic flux is generated, and a magnetic field forming part which has three magnetic pole pieces on more or less the same straight line, and which distributes the magnetic flux so that two magnetic field regions are formed. A slider advances and retracts parallel to a line connecting the magnetic pole pieces in accordance with the magnetic field regions, and is equipped with magnetic members that have two magnetic surfaces of mutually different polarities in the advance and retraction direction, and a magnetic path member.

BEST MODE FOR CARRYING OUT THE INVENTION

Figure 1:
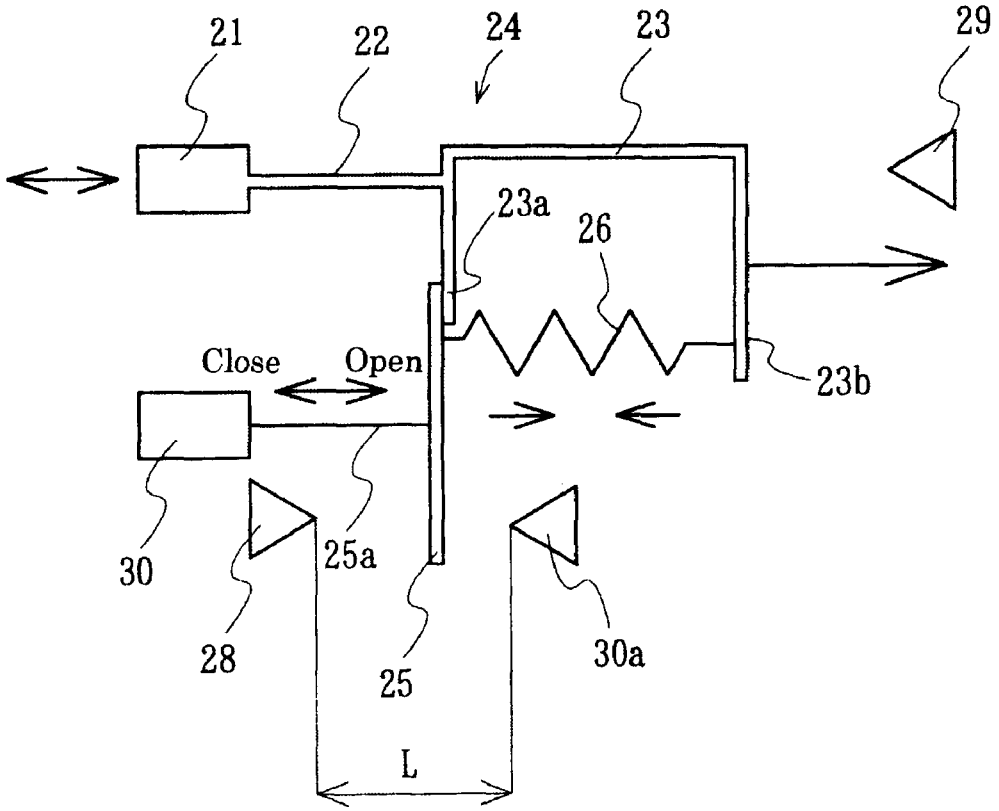
FIG. 1 is a diagram which shows the construction of the throttle valve control device of the present invention in schematic form.
Figure 2:
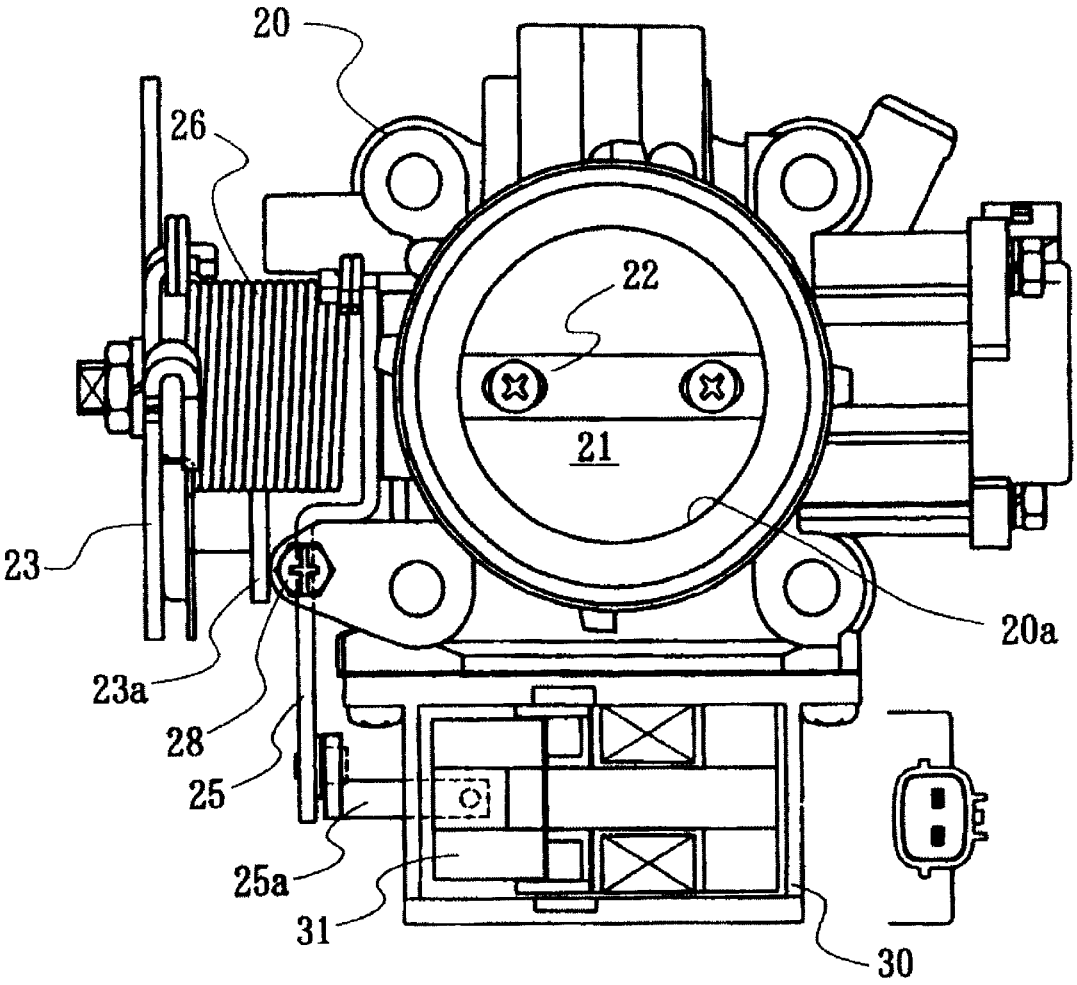
FIG. 2 is a plan view of the throttle valve control device of the present invention.
Figure 3:
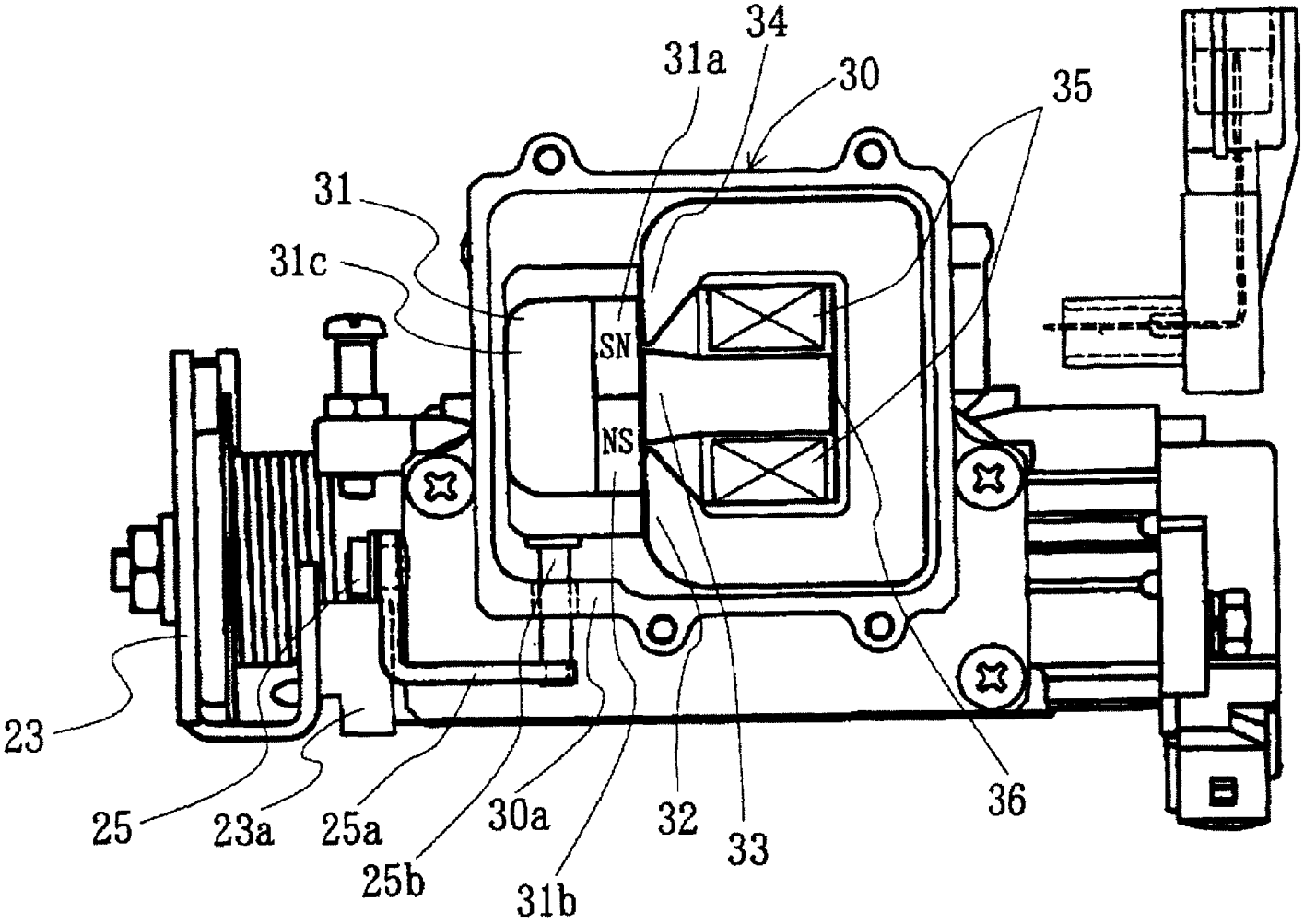
FIG. 3 is a front view of the throttle valve control device of the present invention.
Figure 4:
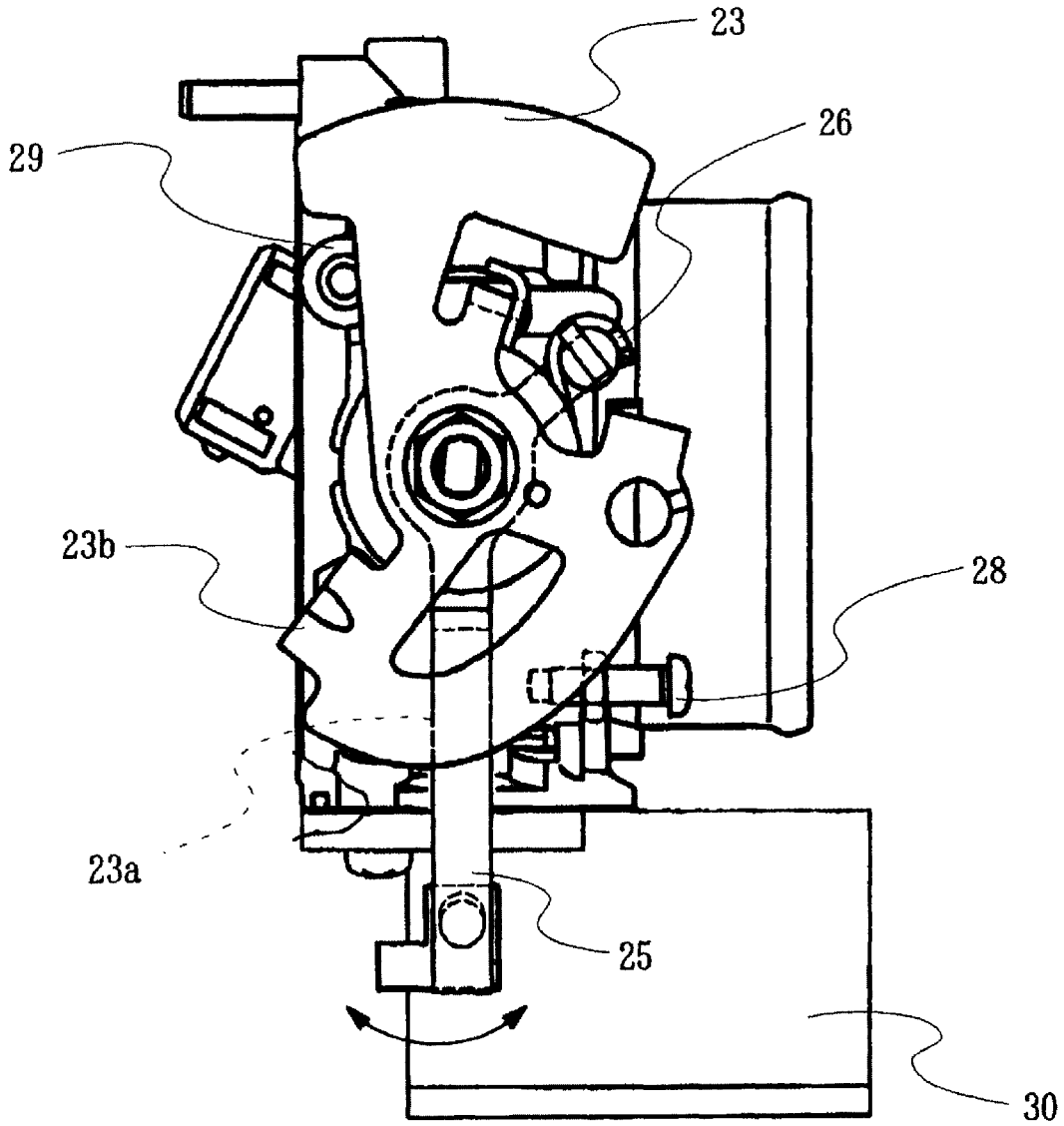
FIG. 4 is a left-side view of the throttle valve control device of the present invention.
Figure 5:
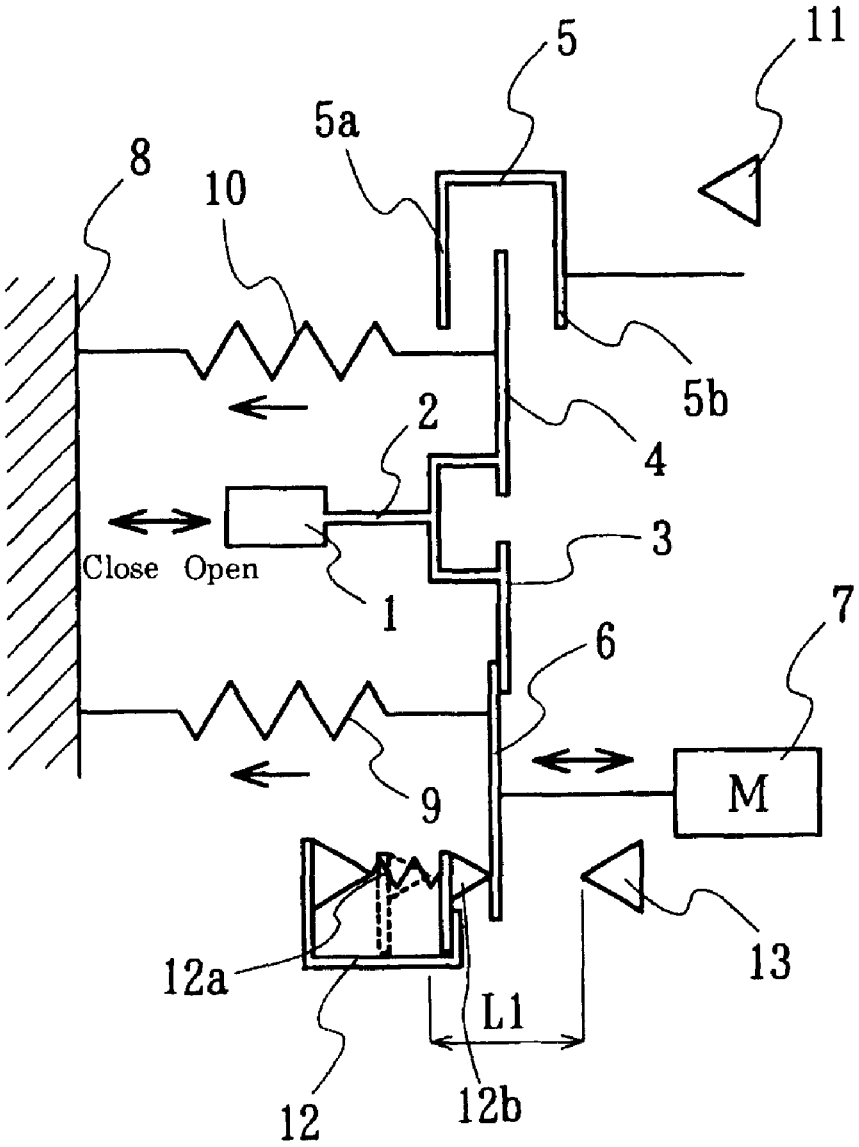
FIG. 5 is a diagram which shows the construction of a conventional throttle valve control device in schematic form.

FIG. 1 is a diagram showing the throttle valve control device of the present invention. This diagram shows the construction of the throttle valve control device in schematic form. Furthermore, FIGS. 2 through 4 are diagrams of a throttle body mounting the throttle valve control device of the present invention; FIG. 2 is a plan view, FIG. 3 is a front view, and FIG. 4 is a left-side view of FIG. 2.

In these figures, a throttle valve 21 is installed inside a bore 20*a* formed on a throttle body 20, and can be freely pivoted by a throttle shaft 22. A throttle lever 23 is fastened to one end of the throttle shaft 22, so that a structural body 24 is formed in which the throttle valve 21, throttle shaft 22 and throttle lever 23 are integrally connected.

A free lever 25 is attached to the throttle shaft 22 so that this free lever 25 is free to pivot. Furthermore, a return spring 26 consisting of a coil spring is mounted between one end of this free lever 25 and one end of the throttle lever 23. Specifically, the throttle lever 23 is urged by the return spring 26 in the direction which causes the throttle valve 21 to close the bore 20*a*, and the free lever 25 is urged in the opposite direction. A projection 23*a* is disposed on the throttle lever 23, and the free lever 25 is urged by the return spring 26 so that the free lever 25 is pressed against this projection 23*a*.

As is shown in FIG. 3, a connecting lever 25*a* is disposed as an extension of the free lever 25. Furthermore, a connecting rod 25*b* is connected to this connecting lever 25*a*, and this connecting rod 25*b* is integrally connected to a slider 31 which passes through a hole in a frame 30*a* of an actuator 30 which is integrally attached to the throttle body 20.

The actuator 30 comprises a linear torque motor. This linear torque motor is constructed from three magnetic pole pieces 32, 33 and 34 that are disposed more or less rectilinearly, and a coil 35 which is mounted between these magnetic pole pieces. Magnetic members 31*a* and 31*b* are disposed on the side of the slider 31 that faces the magnetic pole pieces 32, 33 and 34, and these magnetic members 31*a* and 31*b* are connected by a magnetic path member 31*c*. The magnetic members 31*a* and 31*b* are plate-form members, and have magnetic poles in their thickness direction. The magnetic poles on the surfaces that face the magnetic pole pieces 32, 33 and 34 are arranged so that one of these magnetic poles is an N pole, and the other magnetic pole is an S pole.

In the stator comprising the three magnetic pole pieces 32, 33 and 34 and electromagnetic coil 35, magnetic flux is generated when the electromagnetic coil 35 is powered, so that two magnetic field regions are formed between the three magnetic pole pieces 32, 33 and 34. Furthermore, the magnetic members 31*a* and 31*b* correspond to these magnetic field regions, so that the slider 31 advances and retracts on a straight line. Furthermore, the directions of this advancing and retracting action are determined by switching the polarity of the current.

The principle of operation is that when current flows through the coil 35, the slider 31 moves in accordance with the current value. In actuality, however, this is accomplished by duty control based on a pulse signal. On the other hand, when the coil 35 is not powered, the slider 31 is fixed in a specified position in a state in which the magnetic flux of the magnetizing members 31*a* and 31*b* does not pass through a gap 36. In the present embodiment, as is shown in FIG. 3, the center of the magnetizing members 31*a* and 31*b* is magnetically held in a position at the center of the magnetic pole piece 33. The slider 31 can move from a position in which the connecting part that is connected to the connecting rod 25*b* shown in FIG. 3 contacts the frame 30*a* to a position in which the free lever 25 contacts the stopper 28.

In FIGS. 1 through 4, the throttle valve 21 is at a position toward the opening direction from the fully closed state. In other words, since the throttle lever 23 is linked to the free lever 25 by the return spring 26, and since the connecting rod 25*b* of the free lever 25 is connected to the slider 31 and the slider 31 is fixed in a position determined by the construction, the throttle valve 21 can be stopped at an arbitrary position.

The ordinary acceleration operation is accomplished as follows: specifically, a wire (not shown in the figures) connected to the throttle lever 23 is pulled by the depression of the accelerator pedal installed at the driver's seat, so that the throttle lever 23 is rotated in the clockwise direction in FIG. 4. The throttle lever 23 can rotate until the projection 23*b* contacts the "fully-closed" stopper 29.

ISC is accomplished as follows from the initial position of the throttle lever 23 shown in FIGS. 1 through 4. When the actuator 30 is powered, the slider 31 moves to a position corresponding to the powering current value. As a result, the connecting rod 25*b* and connecting lever 25*a* move so that the free lever 25 rotates about the throttle shaft. In this case, since the free lever 25 and throttle lever 23 make pressing contact at the position of the projection 23*a*, the throttle lever 23 also rotates together with the free lever 25, so that the throttle valve 21 opens and closes. Naturally, the rotation angle of the free lever 25 and the rotation angle of the throttle lever 23 in this case are equal. Furthermore, since one end of the return spring 26 is anchored to the throttle lever 23 and the other end is anchored to the free lever 25, the driving force of the return spring 26 is not applied to the operation of the free lever 25.

The ISC region is the range of opening of the throttle valve 21 by the actuator 30; this is limited by the stroke L in FIG. 1. In the present embodiment, the frame 30*a* of the actuator 30 is used as the upper-limit stopper for ISC. However, it would also be possible to install this part so that the part contacts the free lever 25.

In the present invention, the free lever 25 can pivot completely independently of the driving force of the return spring 26 in the ISC region in which the slider 31 moves through the stroke L. Accordingly, the output of the actuator 30 can be correspondingly reduced, so that the actuator 30 can be made compact.

Furthermore, as a result of the abovementioned construction, a single return spring is sufficient in the present invention, so that the construction can be simplified. Furthermore, since the throttle valve is directly driven in opening and closing, precise ISC control is possible, and the apparatus can be constructed without greatly altering conventional products that use a bypass air passage.

Furthermore, a linear torque motor was used as the actuator in the present embodiment. However, in the abovementioned construction, a stepping motor may also be used, or, if the connecting part between the free lever and the actuator is formed as a gear structure, a DC motor may also be used.

Furthermore, in the present embodiment, the degree of opening of the throttle valve when the actuator was not powered was set in a position located further in the opening direction than the fully closed state. This was done in order to ensure in advance a sufficient amount of air for starting the engine, and in order to make sticking between the throttle valve and bore due to icing or the like less likely to occur. However, the initial position of the opening of the throttle valve is not limited to the range regulated by the ISC upper-limit stopper; this position may be set in a region outside the ISC region so as to allow for safe evasive operation even in cases where the throttle wire is cut as a result of trouble.

INDUSTRIAL APPLICABILITY

The throttle valve control device of the present invention comprises a structural body in which a throttle valve, a throttle shaft and a throttle lever are integrally connected. A return spring, one end of which is anchored to the structural body, urges the throttle valve so that the throttle valve rotates in the closing direction. A free lever is supported on the throttle shaft so that this free lever is free to pivot, anchors the other end of the abovementioned return spring, and can contact and move away from the structural body. An actuator drives the free leverand the driving of the free lever by the actuator causes the structural body to pivot so that the throttle valve is opened and closed. Consequently, the actuator can open and close the throttle valve without being affected by the resistance of the return spring. Accordingly, the actuator can be made compact, and a throttle valve control device which has a simple structure and which can be made compact can be obtained.

If a construction is used in which the actuator opens and closes the throttle valve in the ISC region, the opening and closing of the throttle valve can be directly controlled in the ISC region. Accordingly, a bypass air passage becomes unnecessary, and at the same time, highly precise control becomes possible.

If a construction is used in which the actuator has a stator including a magnetic flux generating part around which an electromagnetic coil is wound so that magnetic flux is generated, and a magnetic field forming part which has three magnetic pole pieces on more or less the same straight line, and which distributes the magnetic flux so that two magnetic field regions are formed, and a slider which advances and retracts parallel to a line connecting the magnetic pole pieces in accordance with the magnetic field regions, and which is equipped with magnetizing members that have two magnetizing surfaces of mutually different polarities in the direction of advance and retraction, and a magnetic path member, the degree of opening of the throttle valve can be controlled continuously and precisely in accordance with the current value.

What is claimed is:

1. A throttle valve control device comprising:

a structural body comprising a throttle valve disposed inside a bore of a throttle body, a throttle shaft supporting said throttle valve so that said throttle valve is free to pivot, and a throttle lever for pivoting said throttle shaft, said throttle valve, said throttle shaft and said throttle lever being integrally connected;

a return spring having one end connected to said structural body and urging said throttle valve to rotate in a closing direction;

a free lever supported on said throttle shaft so that said free lever is free to pivot, said free lever being connected with the other end of said return spring and able to contact and move away from said structural body;

and an actuator for driving said free lever;

wherein driving of said free lever by said actuator causes said structural body to pivot so that said throttle valve is opened and closed in an idling operation.

2. The throttle valve control device according to claim 1, wherein said actuator opens and closes said throttle valve in an ISC region.

3. The throttle valve control device according to claim 2, wherein the actuator comprises:

a stator comprising a magnetic flux generating part around which an electromagnetic coil is wound so that magnetic flux is generated, and a magnetic field forming part which has three magnetic pole pieces substantially on the same straight line and which distributes said magnetic flux so that two magnetic field regions are formed; and a slider comprising a magnetic path member and a magnetic member which advances and retracts in a direction parallel to a line connecting said magnetic pole pieces in accordance with said magnetic field regions, and which has two magnetic surfaces of mutually different polarities in the direction of advance and retraction.

4. The throttle valve control device according to claim 1, wherein the actuator comprises:

a stator comprising a magnetic flux generating part around which an electromagnetic coil is wound so that magnetic flux is generated, and a magnetic field forming part which has three magnetic pole pieces substantially on the same straight line and which distributes said magnetic flux so that two magnetic field regions are formed; and a slider comprising a magnetic path member and a magnetic member which advances and retracts in a direction parallel to a line connecting said magnetic pole pieces in accordance with said magnetic field regions, and which has two magnetic surfaces of mutually different polarities in the direction of advance and retraction.

* * * * *